United States Patent [19]

Sato et al.

[11] Patent Number: 4,948,112

[45] Date of Patent: Aug. 14, 1990

[54] FOLDING MACHINE IN A ROTARY PRESS

[75] Inventors: Manabu Sato; Kazutoshi Nomi; Yasuo Morita; Yukikazu Shoji, all of Mihara, Japan

[73] Assignee: Mitsubishi Jukogyo Kabushiki Kaisha, Tokyo, Japan

[21] Appl. No.: 268,968

[22] Filed: Nov. 9, 1988

[30] Foreign Application Priority Data

Nov. 11, 1987 [JP] Japan ..... 62-284766

[51] Int. Cl.[5] ..... B65H 39/08

[52] U.S. Cl. ..... 270/60; 270/47; 271/303; 271/305

[58] Field of Search ..... 270/52, 4, 5, 6, 7, 270/8, 21.1, 45, 47, 49, 58, 60; 271/302, 303, 305, 304, 202

[56] References Cited

U.S. PATENT DOCUMENTS

| | | | |
|---|---|---|---|
| 4,373,713 | 2/1983 | Loebach | 271/303 |
| 4,490,132 | 12/1984 | Ogura | 270/47 |
| 4,534,552 | 8/1985 | Rahe | 271/302 |
| 4,729,282 | 3/1988 | Kasdorf | 271/303 |

FOREIGN PATENT DOCUMENTS

| | | | |
|---|---|---|---|
| 89407 | 9/1983 | European Pat. Off. | 271/303 |
| 3030706 | 2/1982 | Fed. Rep. of Germany | 270/21.1 |
| 3527710 | 2/1987 | Fed. Rep. of Germany | 270/45 |
| 3534157 | 4/1987 | Fed. Rep. of Germany | 270/47 |
| 1541562 | 3/1979 | United Kingdom | 271/303 |

*Primary Examiner*—Robert E. Garrett
*Assistant Examiner*—Therese M. Newholm
*Attorney, Agent, or Firm*—Wenderoth, Lind & Ponack

[57] ABSTRACT

A folding machine in a rotary press of the type in which a printed a paper web is twice-folded and then cut into folded sheets by means of cutter drums, and the folded sheets are conveyed through a distributor section on the downstream side of the machine to a pair of ejectd paper sheet runners while being pinched by belts, is improved. Namely, a conveyor for conveying the folded sheets includes a pair of first conveyor belts between the outlet side of the cutter drums, and the upstream side of the distributor section, a pair of distributor belts forming the distributor section with a triangular guide disposed on the downstream side thereof, two pairs of second conveyor belts between the downstream side of the distributor section and the inlet sides of the pair of ejected paper sheet runners, and guide belts or fixed guide members extending between a location upstream of the distributor section and the inlet side of the distributor section and between the outlet side of the distributor section and a location downstream of the distributor section. These belt pairs define, respectively, independent closed routes. The pair of distributor belts are respectively provided with uneven portions along their lengths adapted to mesh with each other. Preferably, the pair of distributor belts run at a higher speed than the pair of first conveyor belts, and the two pairs of second conveyor belts run at a higher speed than the pair of distributor belts.

6 Claims, 5 Drawing Sheets

FOLDING MACHINE IN A ROTARY PRESS

BACKGROUND OF THE INVENTION

1. Field of the Invention:

The present invention relates to a folding machine in a rotary press.

2. Description of the Prior Art:

One example of the known folding machine in a rotary press in the prior art is illustrated in FIG. 5(*a*). In this figure, successive sheets cut out from a web by means of a pair of rotating cutter drums 10 and 11 are led to a distributor section D as pinched between a pair of conveyor belts 12 and 13, and are alternately distributed therein different directions. The cut sheets distributed in one direction are pinched between another conveyor belt 25 and the conveyor belt 12 on the downstream side of a tapered guide 23 and are conveyed to a rotary runner 34 in a gathering station at the downstream side of the machine. The remainder of the cut sheets distributed in the other direction are likewise pinched between another conveyor belt 26 and the conveyor belt 13 on the downstream side of the tapered guide 23 and are conveyed to a rotary runner 50 at the downstream side of the machine. In this way, the successive sheets cut out by the cutter drums 10 and 11 are distributed alternately in different directions and are gathered at different gathering stations.

The detailed structure of the distgributor section D is shown in FIGS. 6 and 7. On shafts 62 and 63 disposed parallel to each other and simultaneously driven, are mounted guide rolls 19 and 20 for guiding conveyor belts 12 and 13, respectively, and a pair of rotary sheet diverters 60 and 61 disposed coaxially with the guide rolls 19 and 20. These rotary sheet diverters 60 and 61 are respectively provided with protruding cam surfaces 60*a* and 61*a* and recessed portions 60*b* and 61*b*. In addition, a tapered guide 23 having a pair of diverging sheet guide surfaces 23*a* and 23*b* consisting of concave surfaces is provided between the conveyor belts 12 and 13 so as to define diverging routes just downstream of the rotary sheet diverters 60 and 61. Since the rotary guide rolls 19 (20) and the rotary sheet diverters 60 (61) are disposed alternately on the shaft 62 (63), the belt 12 (13) guided by the rotary guide rolls 19 (20) and the cam surfaces 60*a* (61*a*) provided on the rotary sheet diverters 60 (61) are adapted to be juxtaposed in the widthwise direction of the sheet.

The distribution of the sheets is carried out in the following manner. When the cut sheets SA and SB (See FIG. 5(*b*)) are alternately and continuously fed between the rotary sheet diverters 60 and 61 by the conveyor belts 12 and 13, the initial sheet SA is diverted into the flow path formed between the sheet guide surface 23*a* and the conveyor belt 12 by the protruding cam surface 61*a* of the rotary sheet diverter 61. Subsequently the sheet SA is delivered into a sheet receiving gap formed by the conveyor belts 12 and 25, and thereafter it is sent to the rotary runner 34 existing on the downstream side as pinched by the belts 12 and 25. In succession, the next cut sheet SB is sent between the rotary sheet diverters 60 and 61, but at this time the protruding cam surface 61*a* has been rotated to a position outside of the route for the sheet SB and instead the protruding cam surface 60*a* of the rotary sheet diverter 60 has entered the route for the sheet SB. Hence, the sheet SB is diverted into the flow path formed between the sheet guide surface 23*b* and the conveyor belt 13, and it is sent to the rotary runner 50 that is different from that for the sheet SA by the conveyor belts 13 and 26. Still further, when the sheet SA subsequent to the last-mentioned sheet SB has been sent to the rotary sheet diverter D, the protruding cam surface 60*a* has been rotated to a position outside of the route for the sheet SA. Hence, the cam surface 61*a* again returns into the traveling route for the sheet SA, and the above-described sequence of operations is repeated.

In addition, downstream of the location at which the conveyor belts 12 and 13 are converged by means of a pair of rolls 14 and 15 for the purpose of receiving the successive sheets, they are further guided into parallel routes close to each other by means of rolls 17 and 18, and then they are led into the distributor section D. The conveyor belt 12 is guided to define one route of divergent routes by means of the rotary guide rolls 19 and 20 combined with the distributor section D. And, on the downstream side of the tapered guide 23 conveyor belt 12 defines a closed route jointly with another belt 25 and cooperates therewith to send the distributed sheets to the collecting station. Likewise, after passing through the rotary guide rolls 19 and 20, the conveyor belt 13 cooperates with another belt 26 to send the distributed sheets to the collecting station. In this way, the conveyor belts 12 and 13 form a continuous closed route extending from the position for receiving the cut sheets, through the distributor section D, to the sheet collecting station, further through returning guide rolls and returning to the position for receiving the cut sheets.

However, the cam surfaces in the distributor section in the prior art merely distribute sheets in the diverging space formed by a pair of conveyor belts. They do not have a capability of conveying a sheet while positively holding it. Accordingly, upon passing through the distributor section, a thin paper sheet or a sheet having a small area was liable to be subject to waving, scratching , creasing and paper blocking, and so the reliablity of the prior art device is poor.

Also, since the cam plates and the conveyor belts are juxtaposed in the widthwise direction of the sheets, it is impossible for both the cam plate surface and the conveyor surface to support the sheet edge portions which is a factor causing instability along the width of the sheets. Accordingly, there is a risk that the edge of the sheet may be folded either in the distributor section or in the route between the conveyor belts. Furthermore, since each of the pair of converyor belts is formed of a single belt extending over the route from the position for receiving the cut sheets, through the distributor section and to the sheet collecting station, the belts are compelled to run at a predetermined equal speed over the entire route. Consequently, a waving condition of a sheet generated in the direction of the sheet flow in the space within the diverging belt route before and behind the distributor section would be maintained even at the downstream conveyor belts without being eliminated, and there was a risk that creases would be formed in the sheet in the direction perpendicular to the flow direction.

SUMMARY OF THE INVENTION

It is therefore one object of the present invention to provide an improved folding machine in a rotary press, in which successive printed and cut sheets can stably pass through a distributor section without the occurance of, waving, scratching, creasing and paper blocking.

Another object of the present invention is to provide a folding machine in a rotary press, in which conveyor belts for conveying successive printed and cut sheets through a distributor section can run at different speeds in the respective sections of a conveying route, and thereby the risk of generating creases in the direction perpendicular to the flow direction of the sheets can be elimated.

According to tone feature of the present invention there is provided a folding machine in a rotary press of the type in which a printed paper web is twice-folded and then cut into folded sheets by means of cutter drums, and the folded sheets are conveyed through a distributor section on the downstream side of the machine to a pair of ejected paper sheet runners while being pinched between belts, improved in that conveyor means for conveying the folded sheets comprises a pair of first conveyor belts between the outlet side of the cutter drums and the upstream side of the distributor section, a pair of distributor belts forming the distributor section jointly with a triangular guide disposed on the downstream side thereof, two pairs of second conveyor belts between the downstream side of the distributor section and the inlet sides of the pair of ejected paper sheet runners, and guide belts of fixed guide members extending between a location upstream of the distributor section and the inlet side of the distributor section and between the outlet side of the distributor section and a location downstream of the distributor section. These belt pairs define, respectively, independent closed routes. And, the pair of distributor belts are respectively provided with uneven portions along the belt length which are adapted to mesh with each other. The even portions each consist of a thin part having a length equal to the length of the folded sheets, and a thick part having a length equal to the length of the folded sheets at a pinching section for the folded sheets, and are adapted to pinch the opposite edge portions of the folded sheets.

According to another feature of the present invention, there is provided the above-featured folding machine in a rotary press, further improved in that the pair of distributor belts are made to run at a higher speed than the pair of first conveyor belts, and the two pairs of second conveyor belts are made to run at a higher speed than the pair of distributor belts.

According to the present invention having the above-described structural feature, the folded sheets fed from the cutter drums are at first conveyed to the upper stream of the distributor section by the first conveyor belts, and they enter the distributor section as guided by either the guide belts or the fixed guide members. The foleded sheets having entered the distributor section are distributed in predetermined directions under the condition of being firmly pinched between the mutually meshing parts of the uneven portions of the distributor belts having a length equal to the length of the folded sheet, and then they enter the second conveyor belts as guided by the guide belts or the fixed guide members so as to be conveyed to the ejected paper sheet runners. In addition, by making the first conveyor belts, the distributor belts and the second conveyor belts run at successively increased speeds, the waving condition of the folded sheets can be eliminated and creasing can be prevented.

According to the present invention, due to the above-described structural features and inherent operation, asociated therewith a waving condition of the sheet generated in the flow direction of the sheet can be eliminated, the sheet can be more stably conveyed and even in the case of thin paper sheets or small-sized sheets, the fear of producing waving scratching, creasing and paper blocking can be obviated, and further, the possibility of the sheet edge being folded is eliminated.

The above-mentioned and other objects, features and advantages of the present invention will become more apparent by referring to the following description of one preferred embodiment of the invention taken in conjunction with the accompanying drawings.

BRIEF DESCRIPTION OF THE DRAWINGS

In the accompanying drawings:

FIG. 1(*b*) is a schematic diagram of a series of cut folded sheets;

FIG. 5(*b*) is a schematic diagram of a series of cut folded sheets;

DETAILED DESCRIPTION OF THE PREFERRED EMBODIMENT

Figures 1A, 1B:
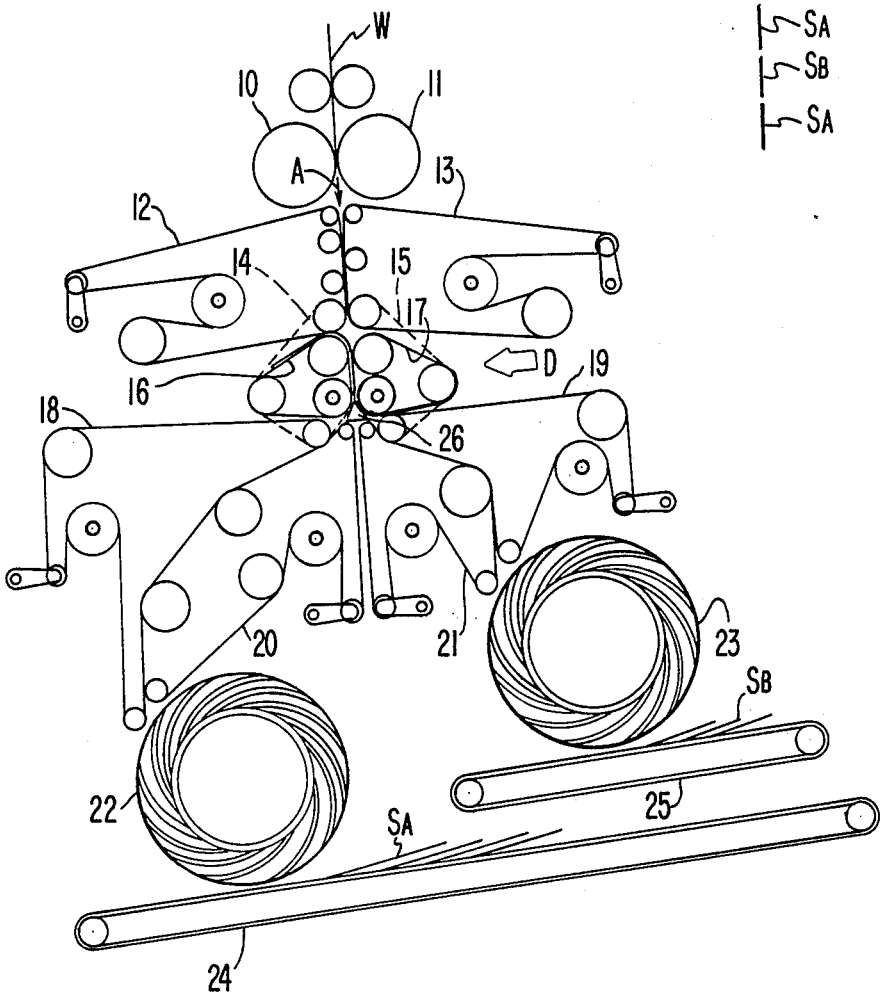
FIG. 1(*a*) is a front view of a folding machine in a rotary press according to one preferred embodiment of the present invention.
Figure 2:
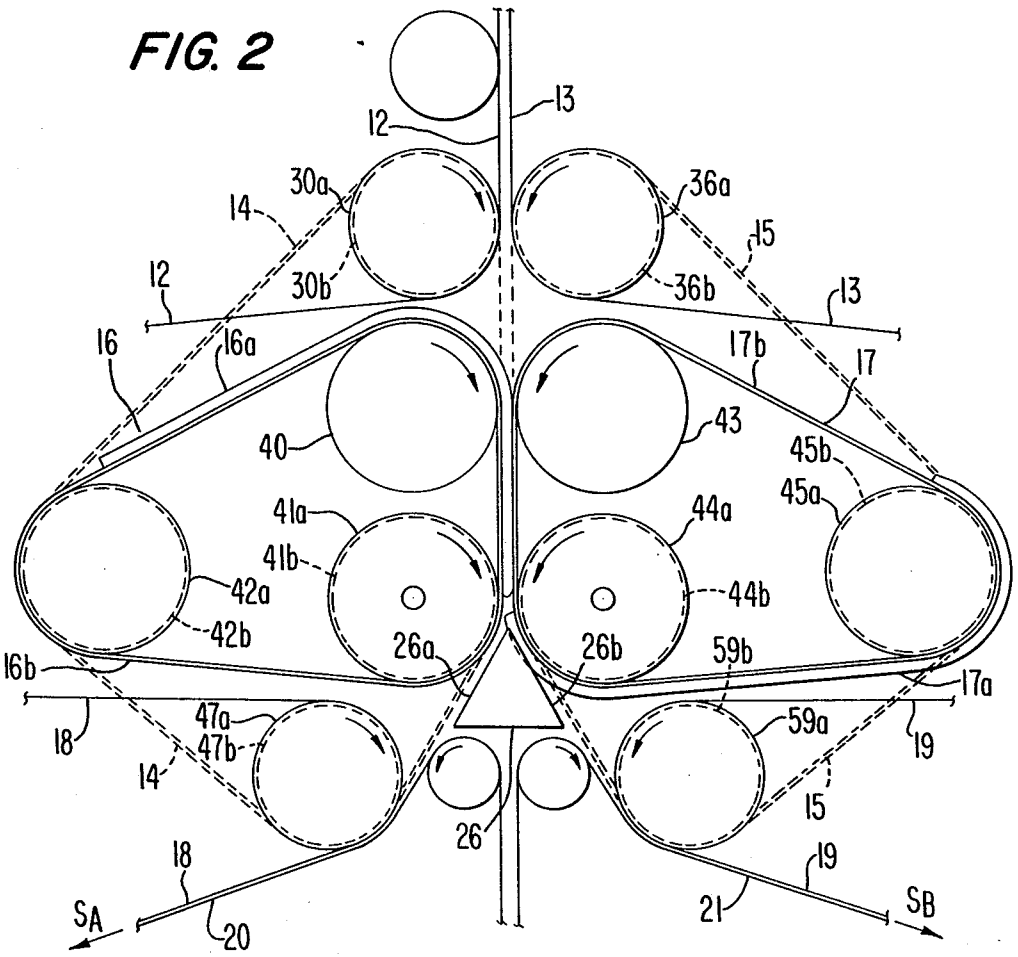
FIG. 2 is an enlarged view of the distributor section D in FIG. 1(*a*)

In the following, the present invention will be described with reference to FIGS. 1 to 4 of the accompanying drawings. As will be seen from these figures, a web W twice-folded by means of a triangular plate (not shown) is cut at predetermined intervals by cutter drums 10 and 11, after it has entered between a pair of first conveyor belts 12 and 13, into folded sheets (hereinafter called simply "sheets") SA and SB. Thereafter, as soon as a folded sheet is released from the first conveyor belts 12 and 13 at rolls 30*a* and 36*a*, it is sent to distributor section D as guided by a pair of guide belts 14 and 15, which are guided by rolls 30*b* and 36*b* provided on the same shafts as the rolls 30*a* and 36*a*, respectively. The sheets SA and SB sent to the distributor section D are distributed alternately to the left and the right with respect to a central running position (that is, the straight line position passing through a point midway between the axes of rolls 40 and 43 and through a point midway between the axes of rolls 41 and 44). Just downstream of the distributor section D, the pair of guide belts 14 and 15 are guided in a diverging manner by rolls 47*b* and 59*b*, and within the diverging routes defined by the guide belts is disposed a triangular guide 26 having an apex disposed on the above-mentioned central running position and directed to the upstream side of the machine. The sheet SA distributed in one direction at the distributor section D passes through the path between one guide surface 26*a* and the guide belt 14 and is sent between a pair of second conveyor belts 18 and 20 at the downstream side of the machine. The succeeding sheet SB is distributed in the other direction, then passes through the path between the other guide surface 26b and the guide belt 15 and is sent between a pair of second conveyor belts 19 and 21 at the downstream side of the machine. In this way, the sheets SA and SB which have been guided through the same route up to the first conveyor belts are alternately distributed to diffeent routes, that is, to the route defined between the pair of second conveyor belts 18 and 20 and to the route defined between the other pair of second conveyor belts 19 and 21. The sheets SA is discharged via an ejected paper sheet runner 22 onto an ejected paper sheet conveyor 24 and is then set to one collecting station. Likewise, the sheet SB is discharged via an ejected paper sheet runner 23 onto an ejected paper sheet conveyor 25 and is then sent to another collecting station.

The distributor section D consists of a pair of distributor belts 16 and 17, rolls 40, 41a and 42a and rolls 43, 44a and 45a for respectively guiding these distributor belts on the same shafts as the rolls 41a and 42a and the rolls 44a and 45a are respectively provided rolls 41b and 42b and rolls 44b and 45b for guiding a pair of guide belts 14 and 15, respectively. The running path of the distributor belt 16 between the rolls 40 and 41a and the running path of the distributor belt 17 between the rolls 43 and 44a are parallel to each other, and thus form a parallel running section of the sheets SA and SB. The pair of distributor belts 16 and 17, respectively, have uneven portions consisting of thick parts 16a and 17a and thin parts 16b and 17b along the belt length, and they revolve synchronously so that the thick part 16a and the thin part 17b, and the thin part 16b and the thick part 17a may mesh with each other with the sheets SB and SA, respectively, pinched therebetween in the above-mentioned parallel running section. As a matter of course, these uneven portions of the distributor belts 16 and 17 have a sufficient length or pinching the sheet SA or SB over its entire length.

When the sheets SA and SB have been fed to the distributor section D having the structure described above, at first the sheet SA is pinched between the thin part 16b and the thick part 17a of the distributor belts 16 and 17, respectively, and is sent downstream under the condition of being shifted from the above-mentioned central running position towards the distributor belt 16. Therefore, it advances into the gap between one guide surface 26a (on the side of the distributor belt 16) of the triangular guide 26 having its upstream side apex disposed at the above-mentioned central running position, and one guide belt 14 so as to be guided in a diverging manner. The next succeeding sheet SB is now pinched between the thick part 16a and the thin part 17b of the distributor belts 16 and 17, respectively, and is sent downstream under the condition of being shifted from the above-mentioned central running position towards the distributor belt 17. Therefore, it advances into the gap between the other guide surface 26b (on the side of the distributor belt 17) of the triangular guide 26 and the other guide belt 15. In this way, the sheets are fed continuously to the distributor section D under the alternate distributing operations described which are repeated.

Figure 3:
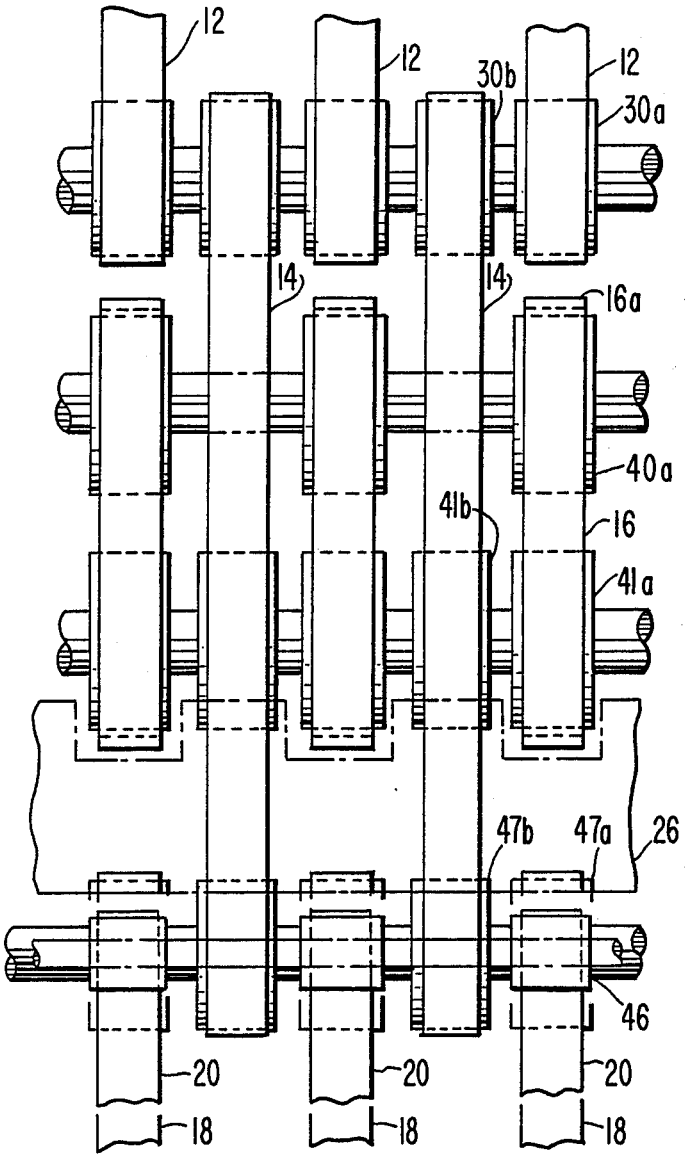
FIG. 3 is a side view of the distributor section D in FIG. 2.

In addition, as shown in FIG. 3, the distributor belt 16 (17) in the distributor section D is disposed so as to pinch the opposite edge portions of a sheet like the first conveyor belt 12 (13) upstream thereof and the second conveyor belts 18 and 20 (19 and 21) downstream thereof, and this unstable behavior of the opposite edge portions of a sheet during high speed conveyance can be prevented.

Figure 4:
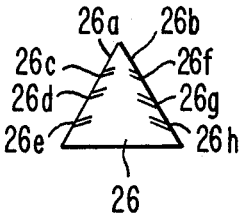
FIG. 4 is a front view of a triangular guide.
Figure 5A:
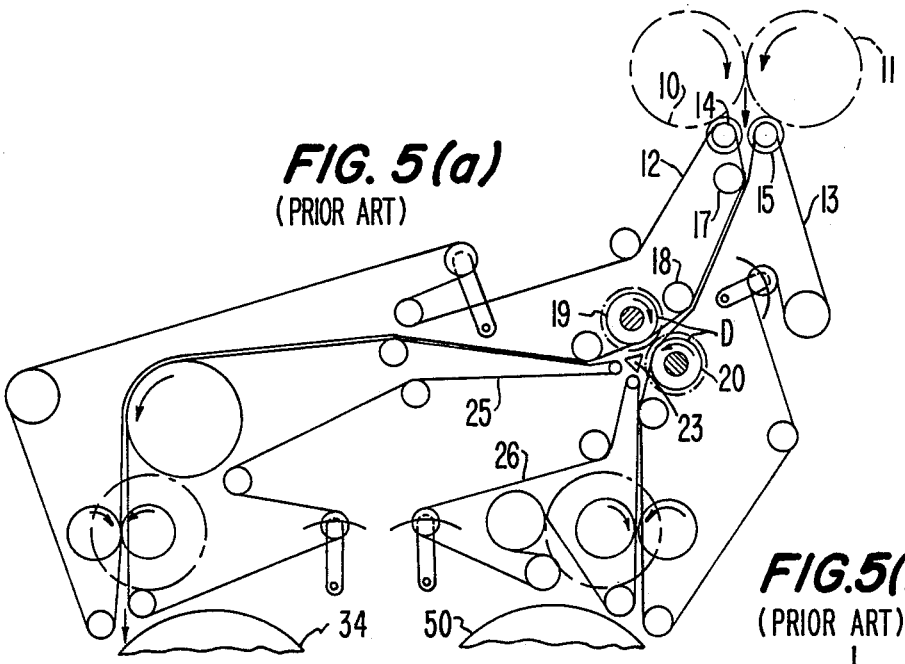
FIG. 5(a) (PRIOR ART)
FIG. 5(*a*) is a front view of a folding machine in a rotary press in the prior art.
Figure 5B:
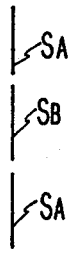
FIG.5(b) (PRIOR ART)
Figure 6:
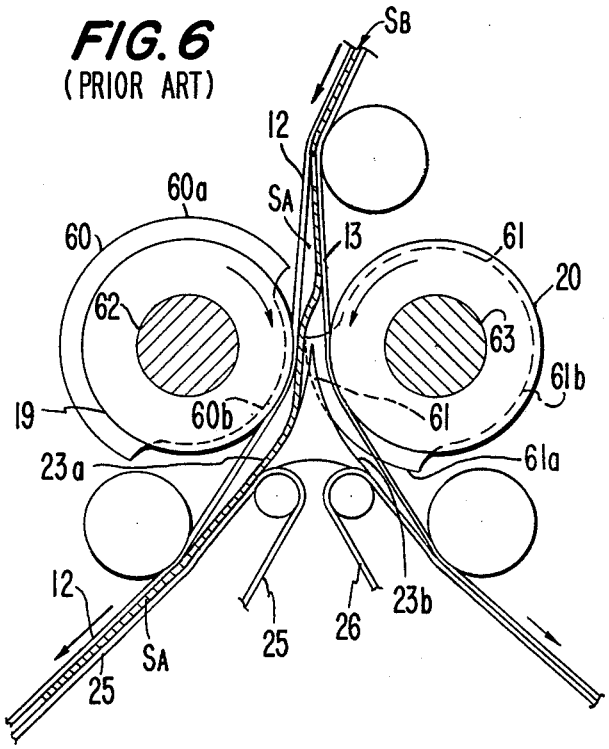
FIG. 6 (PRIOR ART)
FIG. 6 is an enlarged front view of the distributor section D in FIG. 5(*a*)
Figure 7:
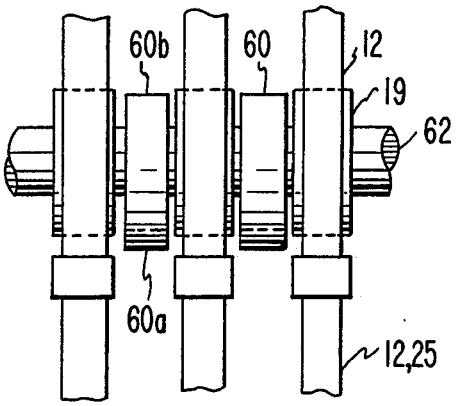
FIG. 7 (PRIOR ART)
FIG. 7 is a side view of the distributor section D in FIG. 6.

Furthermore, since the pair of first conveyor belts 12 and 13, the pair of distributor belts 16 and 17, and the two pair of second conveyor belts 18 and 20, and 19 and 21, are guided so as to run respectively through independent closed routes, and are adapted to be driven respectively by independent drive rolls, the first conveyor belts 12 and 13 can be made to run at several percent to ten and several percent faster than the running speed of the web W before cutting for the purpose of increasing a sheet interval after cutting to several tens of millimeters, the pair of distributor belts 16 and 17 can be made to run at several tenths of a percent to several percent higher speed than the running speed of the first conveyor belts 12 and 13, and the second conveyor belt pairs 18 and 20, and 19 and 21 can be made to run at several tenths of a percent to several percent faster than the running speed of the distributor belts 16 and 17. Thus, it is possible to eliminate a waving condition of the sheets and to prevent creasing of the sheets. In addition, if the triangular guide 26 is provided with nozzle holes 26c, 26d and 26e and nozzle holes 26f, 26g and 26h, respectively, on the guide surfaces 26a and 26b as shown in FIG. 4 according to necessity, then by blowing out pressurized air from these holes, the sheets can be made to pass without coming into contact with the guide surfaces 26a and 26b, and also by blowing out charged air, state electricity on the sheets can be removed.

In order for the gap widths the sheet pinching portions of the first conveyor belts 12 and 13, the distributor belts 16 and 17, the second conveyor belts 18 and 20, and 19 and 21, and the guide belts 14 and 15 to be variable depending upon the thickness and the property of the sheets, the roll groups for guiding these belts are respectively mounted to separate frames (not shown), and these frames can be moved to the left or to the right in the machine.

It is to be noted that while the guide belts 14 and 15 running nearly at the same speed as the distributor belts 16 and 17 are employed in the illustrated embodiment, in the case where the stiffness of the paper sheet to be handled is not small, instead of the guide belts 14 and 15, fixed paper sheet guides could be disposed between the first conveyor belts 12 and 13 and the distributor belts 16 and 17, and along the guide surfaces 26a and 26b of the triangular guide 26 and between the distributor belts 16 and 17 and the respective second conveyor belts 18 and 20, and 19 and 21, respectively.

As described in detail above, in the folding machine in a rotary press according to the present invention, since the conveyor means for the sheets extending from the cutter drums to the ejected paper sheet runners comprises first conveyor belts, distributor belts, and second conveyor belts and guide belts (or fixed guide members), a waving condition of the sheet generated in the flow direction of the sheet can be eliminated by selecting the conveying speed on the downstream side to be a little faster than that on the upstream side. Also, by forming a flat portion having a length equal to the sheet length at the sheet pinching portion by means of the distributor belts, the sheet can be sufficiently pinched by the distributor belts. Hence, even when thin paper sheets or small-sheets are conveyed waving, scratching, creasing and paper blocking can be eliminated. And further, since the opposite edge portions of the sheet which can account for the most unstable behavior during conveyance are pinched except by the guide belts, there is no possibility of the sheet edge portions being folded.

While the present invention has been described above in connection with one preferred embodiment of the invention it is a matter of course that many apparently widely different embodiments of the present invention could be made without departing from the spirit of the present invention.

What is claimed is:

1. A distributing device for feeding sheets in succession in a sheet feed direction and distributing the successively fed sheets in directions different from said sheet feed direction, said device comprising:

conveying means for feeding sheets in the sheet feed direction, said conveying means comprising a first pair of coacting endless conveyor belts;

a distributor section including a pair of coacting endless distributor belts disposed downstream of said first pair with respect to the sheet feed direction for receiving sheets fed by said conveying means and for feeding the received sheets in a central sheet feed direction, and a triangular guide disposed at a downstream side of a said pair of coacting endless distributor belts with respect to said central sheet feed direction, said triangular guide having a pair of guide surfaces intersecting at an apex of said triangular guide from guiding therealong respective ones of sheets discharged from said pair of coacting distributor belts, said distributor belts having respective uneven portions defined along the lengths thereof and which uneven portions are in meshing engagement with one another, each of the uneven portions being a thick portion of a respective said distributor belt and a thin portion of the respective said distributor belt which is thinner than said thick portion wherein the thick portion of one of said distributor belts coacts with the thin portion of the other of said distributor belts while the thin portion of said one of said distributor belts coacts with the thick portion of said other of said distributor belts; and two second pairs of coacting endless belts disposed downstream of said distributor section wth respect to the direction in which sheets are guided by the guide surfaces of said triangular guide, each of said second pairs of coacting endless belts being associated with a respective one of the guide surfaces of said triangular guide for distributing sheets which have been guided therealong in a respective direction of distribution.

2. A distributing device as claimed in claim 1, and further comprising guide means, extending from a location in the machine upstream of said distributor section with respect to the central sheet feed direction to the inlet of said coacting endless distributor belts of said distributor section, and from the outlet of the coacting endless distributor belts of said distributor section to a location in the machine downstream of said distributor section with respect to the central sheet feed direction, for guiding sheets to and from said distributor section.

3. A distributing device as claimed in claim 2, wherein said guide means comprises a pair of endless belts.

4. In a folding machine of a rotary press having cutter drums of cutting a web into sheets, a pair of ejected paper sheet runners for discharging the sheets from the machine, and a distributor section disposed in the machine between said cutter drums and said paper sheet runners for distributing the sheets between said paper sheet runners, the improvement comprising:

conveying means comprising a first pair of coacting endless conveyor belts disposed between the cutting drums and the distributor section for conveying sheets having been cut by said cutting drums to the distributor section in a sheet feed direction;

the distributor section including a pair of coacting endless distributor belts disposed downstream of said first pair with respect to the sheet feed direction for receiving sheet fed by said conveying means and for feeding the received sheets in a central sheet feed direction, and a triangular guide disposed at a downstream side of said pair of coacting endless distributor belts with respect to the central sheet feed direction, said triangular guide having a pair of guide surfaces intersecting at an apex of said triangular guide for guiding therealong respective ones of sheets discharged from said pair of coacting distributor belts, said distributor belts having respective uneven portions defined along the lengths thereof and which uneven portions are in meshing engagement with one another, each of the uneven portions being a thick portion of a respective said distributor belt and a thin portion of the respective said distributor belt which is thinner than said thick portion wherein the thick portion of one of said distributor belts coacts with the thin portion of the other of said distributor belts while the thin portion of said one of said distributor belts coacts with the thick portion of said other of said distributor belts; and two second pairs of coacting endless belts disposed between said distributor section and said paper sheet runners, respectively, each of said second pairs of coacting endles belts being associated with a respective one of the guide surfaces of said triangular guide for distributing sheets which have been guided therealong toward said paper sheet runners.

5. The improvement in a folding machine of a rotary press in claimed in claim 4, and further comprising guide means extending, from a location in the machine upstream of said distributor section with respect to the central sheet feed direction to the inlet of sad coacting endless distributor belts of said distributor section, and from the outlet of the coacting endless distributor belts of said distributor section and a location in the machine downstream of said distributor section with respect to the central sheet feed direction, for guiding sheets to and from said distributor section.

6. The improvement in a folding machine of a rotary press as claimed in claim 5, wherein said guide means comprises a pair of endless belts.

* * * * *